US009472898B2

(12) United States Patent
Yang et al.

(10) Patent No.: US 9,472,898 B2
(45) Date of Patent: Oct. 18, 2016

(54) SMALL FORM-FACTOR PLUGGABLE CONNECTOR WITH A LOCKING AND UNLOCKING MECHANISM

(71) Applicant: Teralux Technology Co., Ltd., Kunshan, Jiangsu Province (CN)

(72) Inventors: Hsin Chih Yang, Kunshan (CN); Wei Chen, Kunshan (CN); Jin Hua Meng, Kunshan (CN)

(73) Assignee: Teralux Technology Co., LTD (CN)

( * ) Notice: Subject to any disclaimer, the term of this patent is extended or adjusted under 35 U.S.C. 154(b) by 0 days.

(21) Appl. No.: 14/811,395

(22) Filed: Jul. 28, 2015

(65) Prior Publication Data

US 2016/0218464 A1 Jul. 28, 2016

(30) Foreign Application Priority Data

Jan. 23, 2015 (CN) ..... 2015 2 0046317 U

(51) Int. Cl.
*H01R 13/627* (2006.01)
*H01R 13/639* (2006.01)

(52) U.S. Cl.
CPC ..... *H01R 13/6395* (2013.01); *H01R 13/6272* (2013.01)

(58) Field of Classification Search
CPC ..... H01R 13/6395; H01R 13/627; H01R 13/6272
USPC ..... 439/352
See application file for complete search history.

(56) References Cited

U.S. PATENT DOCUMENTS 7,699,641 B2 * 4/2010 Bright ..... H01R 13/6275 439/352
8,475,199 B2 * 7/2013 Wang ..... H01R 13/6275 439/160
8,500,470 B2 * 8/2013 Wang ..... G02B 6/4261 385/53
8,545,252 B2 * 10/2013 Wang ..... H01R 13/6275 439/352
8,556,646 B2 * 10/2013 Kappla ..... G02B 6/4246 439/352
8,562,373 B2 * 10/2013 Wu ..... H01R 13/6335 439/352
8,986,036 B2 * 3/2015 Lindkamp ..... G02B 6/4246 439/160
9,130,308 B2 * 9/2015 Wang ..... H01R 13/6275
2006/0153503 A1 * 7/2006 Suzuki ..... G02B 6/3807 385/53
2009/0209125 A1 * 8/2009 Bright ..... H01R 13/6275 439/352
2014/0134898 A1 * 5/2014 Wang ..... H01R 13/6275 439/843
2014/0193993 A1 * 7/2014 Meng ..... H01R 13/633 439/352
2014/0235091 A1 * 8/2014 Wang ..... H01R 13/6275 439/352

* cited by examiner

*Primary Examiner* — Abdullah Riyami
*Assistant Examiner* — Nader Alhawamdeh
(74) *Attorney, Agent, or Firm* — Roger D. Emerson; Emerson Thompson Bennett, LLC

(57) ABSTRACT

A small form factor pluggable connector with a locking and unlocking mechanism is disclosed. The locking and unlocking mechanism includes a torsion spring mounted on a base, an actuator rotatably mounted on a cover, a rotating member rotatably mounted on the cover and the base, and a fastening shaft inserting into a cylindrical spring body of the torsion spring and shaft holes of the cover and the base. When the locking and unlocking mechanism is in an initial state or a locking state, a hook of the rotating member protrudes from a top surface of a front portion of the cover, and a spring-pressing portion of the rotating member presses a horizontal pin of the torsion spring. When the locking and unlocking mechanism is in an unlocking state, a handle of the actuator need be lifted up.

8 Claims, 9 Drawing Sheets

SMALL FORM-FACTOR PLUGGABLE CONNECTOR WITH A LOCKING AND UNLOCKING MECHANISM

BACKGROUND OF THE INVENTION

1. Field of the Invention

The present invention relates to a connector technology and more particularly to a small form-factor pluggable connector with a locking and unlocking mechanism.

2. Description of the Prior Art

At present, a small form-factor pluggable (SFP) connector is a common optical and electric communication transceiver module. Generally, the SFP connector disposes a locking mechanism. When the SFP connector needs to be connected to a receptacle connector, the SFP connector is firstly inserted into a shielding case and is fixed in the shielding case by the locking mechanism, thereby ensuring the connection safety between the SFP connector and the receptacle connector. When needing to disconnect the SFP connector from the receptacle connector, the SFP connector is firstly detached from the shielding case by an unlocking mechanism, so the SFP connector can be fast pulled out from the receptacle connector.

However, the connector is becoming smaller and smaller, and the intensive degree of the receptacle connector in an electronic equipment is gradually increased. Therefore, the mechanism attaching or detaching the SFP connector from the shielding case becomes more complex, and the operation thereof also becomes more difficult.

Hence, it is necessary to provide a new SFP connector to simplify the lock and unlocking mechanism and further simplify the operation thereof

BRIEF SUMMARY OF THE INVENTION

An object of the present invention is to provide a small form-factor pluggable connector with a locking and unlocking mechanism, wherein the SFP connector can be locked and unlocked and the operation mode of the locking and unlocking mechanism is extremely convenient and fast.

To achieve the above object or other objects of the present invention, the present invention adopts the following technical solution.

The present invention provides a small form-factor pluggable connector with a locking and unlocking mechanism, comprising a base, a cover and a locking and unlocking mechanism. The base has an inserting portion located in the front thereof and a retaining portion located in the rear thereof The retaining portion includes a retaining passage located a top surface of the retaining portion, a spring seat disposed on the bottom of the retaining passage, a spring retaining hole formed on the bottom of the retaining passage and located at rear of the spring seat, and a first shaft hole passing through a left and right surfaces of the retaining portion and being cut into two sections by the retaining passage. The cover has a front portion corresponding to the inserting portion and a rear portion corresponding to the retaining portion. The rear portion includes an opening corresponding to the retaining passage of the base, a second shaft hole corresponding to the first shaft hole, and a bottom groove located at rear of the second shaft hole. The front portion includes a receiving chamber concaved downward from a top surface of the front portion and communicated with the opening. When the cover being mounted on the base, the retaining passage, the spring seat and the spring retaining hole are exposed in the opening, the second shaft hole is aligned with the first shaft hole, the bottom groove is closed by the top surface of the retaining portion, and the receiving chamber is communicated with the retaining passage of the base. The locking and unlocking mechanism includes a torsion spring, an actuator, a rotating member and a fastening shaft. The torsion spring is mounted on the spring seat of the base. The torsion spring has a cylindrical spring body, a vertical pin extending from one end of the cylindrical spring body and being inserted into the spring retaining hole, and a horizontal pin extending from the other end of the cylindrical spring body and entering into the receiving chamber. The actuator is rotatably mounted on the cover. The actuator includes a horizontal rod rotatably held in the bottom groove, a handle connected with the horizontal rod and located outside the base and the cover, and an arc-shaped protrusion protruding backward on the horizontal rod and being exposed in the opening. The rotating member is rotatably mounted on the cover and the base. The rotating member has a main body received in the retaining passage and the opening, a receiving cavity formed on the bottom of the main body and used to cover the cylindrical spring body of the torsion spring, a third shaft hole that passes through two sides of the main body to be divided into two sections by the receiving cavity and is aligned with the first and second shaft holes, a latch arm located in front of the third shaft hole and protruding forward from the front of the main body to enter into the receiving chamber, a hook located on the top of the latch arm and protruding out of the top surface of the front portion, a spring-pressing portion located on the bottom of the latch arm and pressed unto the horizontal pin of the torsion spring, a driving surface located in rear of the third shaft hole and pressed unto the arc-shaped protrusion, and a vertical wall located in rear of the driving surface and extending downward over the driving surface to stand on the top surface of the retaining portion. The fastening shaft is inserted into the first shaft hole, the second shaft hole, the third shaft hole and the cylindrical spring body of the torsion spring, and the rotating member is pivoted on the base and the cover.

In one embodiment, the spring seat has an arc-shaped concave surface, a front block standing at front of the arc-shaped concave surface, and a rear block standing at rear of the arc-shaped concave surface; the cylindrical spring body of the torsion spring is contained in the arc-shaped concave surface, the vertical pin is inserted into the spring retaining hole along a rear surface of the rear block, and the horizontal pin extends from one side of the front block into the receiving chamber.

In one embodiment, the actuator further includes two U-shaped frames to connect the handle and the horizontal rod, and the handle and the horizontal rod are parallel to each other.

In one embodiment, the driving surface of the rotating member is a horizontal plane, and the spring-pressing portion is a block extending downward.

In one embodiment, the rear portion of the cover is frame-shaped and has a top wall, a left sidewall and a right sidewall; the opening cuts the top wall into two parts, the second shaft hole passes through the left and right sidewalls, and the bottom groove is formed on the bottom of the top wall.

In one embodiment, a top surface of the rear portion is higher than the top surface of the front portion to form a shoulder between the front portion and the rear portion, and the receiving chamber is located near the shoulder.

In one embodiment, the small form-factor pluggable connector further comprises a grounding shell surrounding the cover and the base, being located near the shoulder, and forming a plurality of elastic pieces extending toward the shoulder.

In one embodiment, the inserting portion of the base disposes a support beam for being used to support a bottom wall of the receiving chamber.

In comparison with the prior art, the SFP connector of the present invention has the locking and unlocking mechanism, which can be conveniently and fast operated and can efficiently perform the locking and unlocking function.

DETAILED DESCRIPTION OF THE PREFERRED EMBODIMENTS

The following description of every embodiment with reference to the accompanying drawings is used to exemplify a specific embodiment, which may be carried out in the present invention. Directional terms mentioned in the present invention, such as "top", "bottom", "front", "back", "left", "right", "top", "bottom" etc., are only used with reference to the orientation of the accompanying drawings. For example, the following description may refer to the orientation of FIG. 1. Therefore, the used directional terms are intended to illustrate, but not to limit, the present invention.

Figure 1:
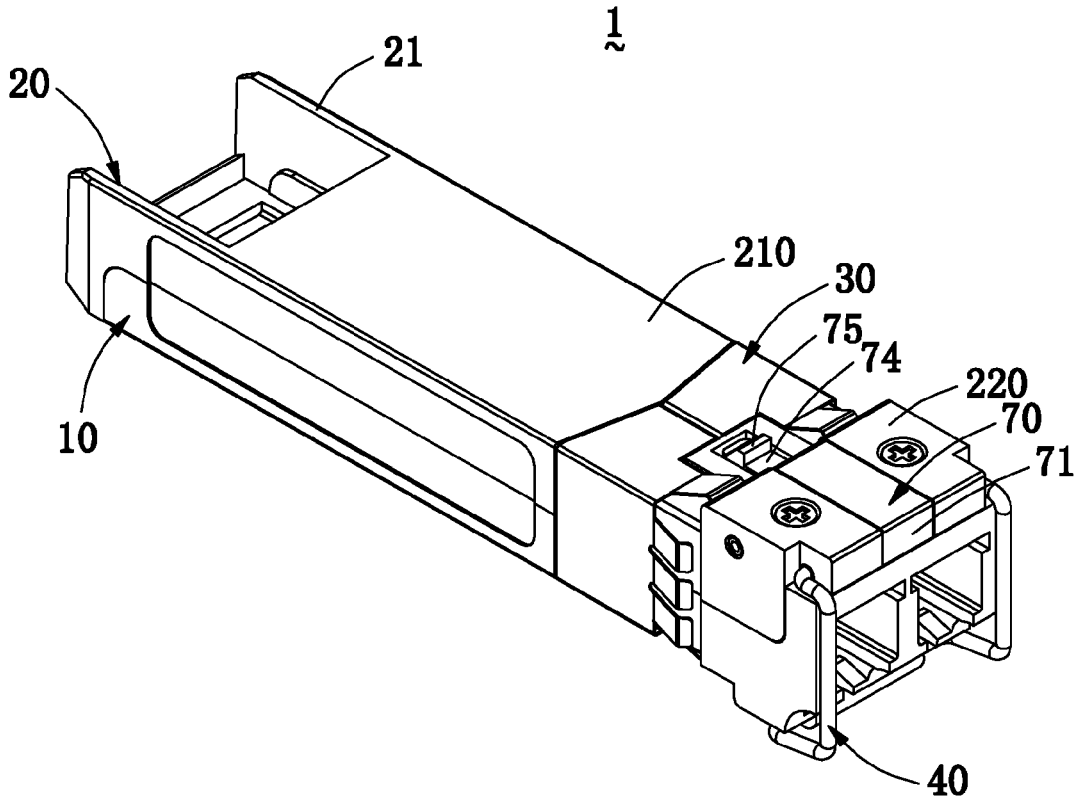
FIG. 1 is a perspective schematic view of a SFP connector with a locking and unlocking mechanism of the present invention.
Figure 2:
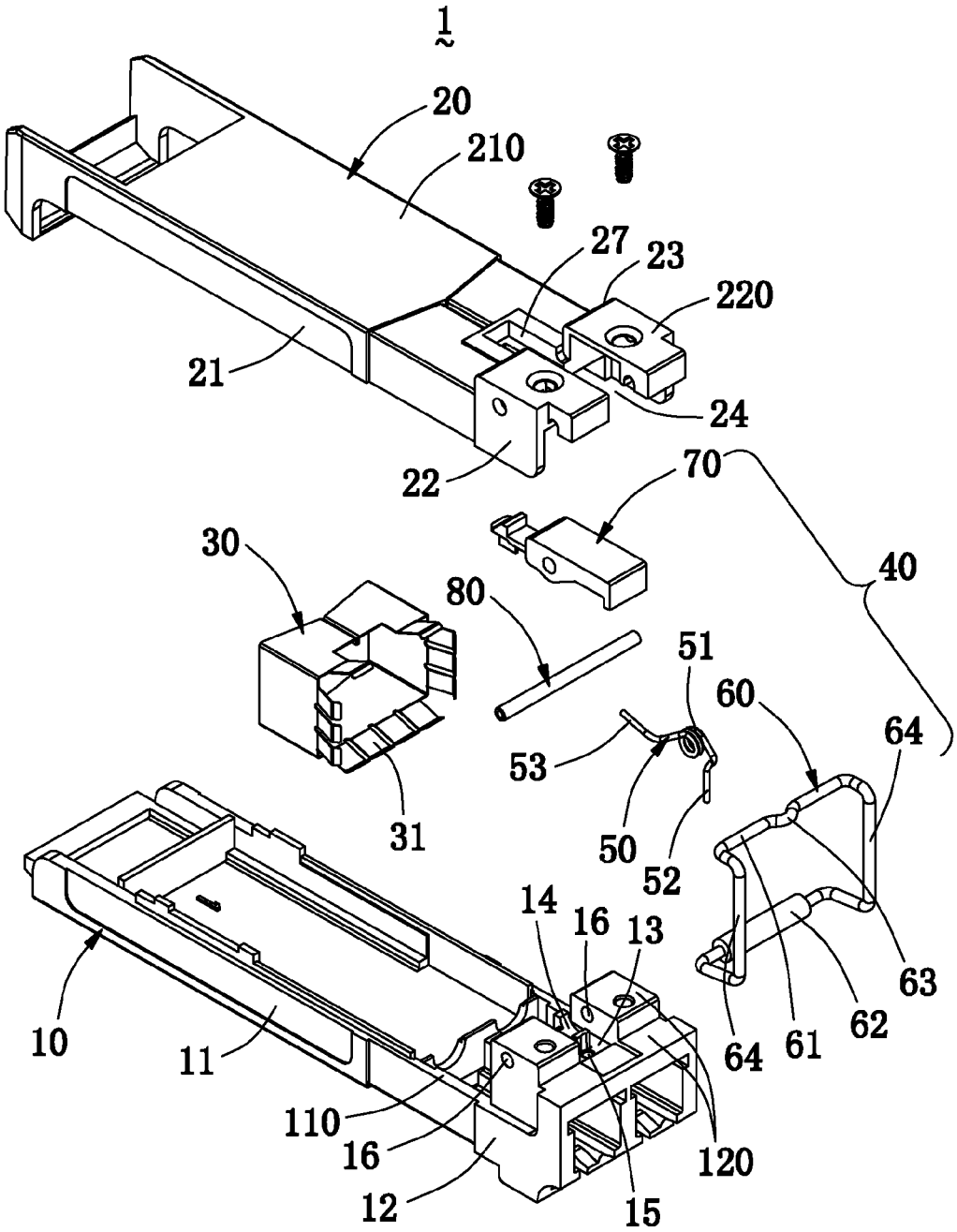
FIG. 2 is an exploded view of the SFP connector with a locking and unlocking mechanism of the present invention.

Please refer to FIGS. 1 and 2, a small form-factor pluggable (SFP) connector 1 of the present invention mainly comprises a base 10, a cover 20 being mounted on the base 10, a grounding shell 30 surrounding and being fixed on the base 10 and the cover 20, and a locking and unlocking mechanism 40 being mounted on the base 10 and the cover 20.

Please refer to FIG. 2, the base 10 includes an inserting portion 11 located in the front thereof and a retaining portion 12 located in the rear thereof. A top surface 120 of the retaining portion 12 is higher than a top surface 110 of the inserting portion 11. The cover 20 has a front portion 21 corresponding to the inserting portion 11 and a rear portion 22 corresponding to the retaining portion 12. A top surface 220 of the rear portion 22 is higher than a top surface 210 of the front portion 21, thereby forming a shoulder 23 between the front portion 21 and the rear portion 22. Please refer to FIG. 6, the front portion 21 of the cover 20 is mounted on the inserting portion 11 of the base 10, and the rear portion 22 of the cover 20 is mounted on the retaining portion 12 of the base 10 by screws 200. Generally, the inserting portion 11 and the front portion 21 may be inserted into a shielding case 9 (shown in FIG. 10) for being connected with a receptacle connector (now shown), but the retaining portion 12 and the rear portion 22 are exposed to the outside of the shielding case 9.

Please refer to FIG. 2, the grounding shell 30 surrounds the front portion 21 of the cover 20 and the inserting portion 11 of the base 10 and is located near the shoulder 23. The grounding shell 30 forms a plurality of elastic pieces 31 extending toward the shoulder 23. When the SFP connector 1 is inserted into the shielding case 9 shown in FIG. 10, the elastic pieces 31 of the grounding shell 30 can elastically contact with an inner wall of the shielding case 9 to form a complete grounding path.

Figure 3:
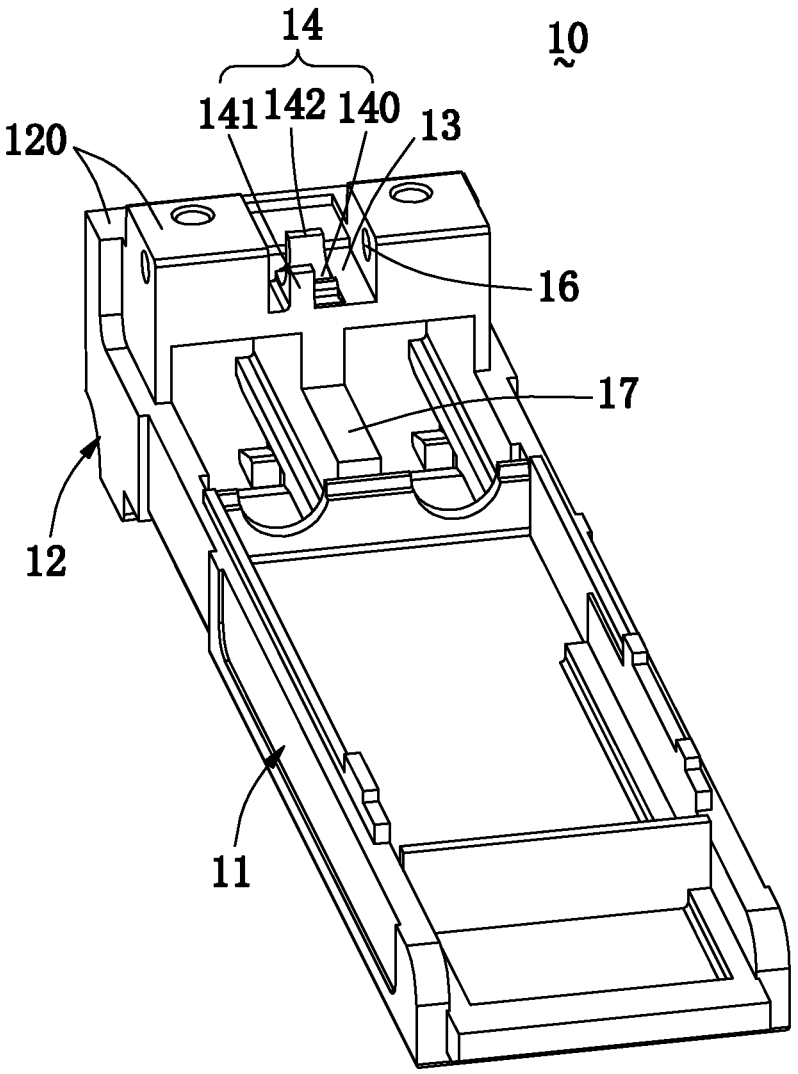
FIG. 3 is a perspective schematic view along another direction of a base of FIG. 2.

Please refer to FIGS. 2 and 3, the retaining portion 12 of the base 10 includes a retaining passage 13 located the middle of the top surface 120, a spring seat 14 disposed on the bottom of the retaining passage 13, a spring retaining hole 15 formed on the bottom of the retaining passage 13 and located at rear of the spring seat 14, and a first shaft hole 16 passing through a left and right surfaces of the retaining portion 12 and being cut into two sections by the retaining passage 13. As shown in FIG. 3, the spring seat 14 has an arc-shaped concave surface 140, a front block 141 standing at front of the arc-shaped concave surface 140, and a rear block 142 standing at rear of the arc-shaped concave surface 140. In this embodiment, as shown in FIG. 3, the inserting portion 11 of the base 10 disposes a support beam 17 being adjacent to the retaining portion 12 and being lower than the bottom of the retaining passage 13.

Figure 4:
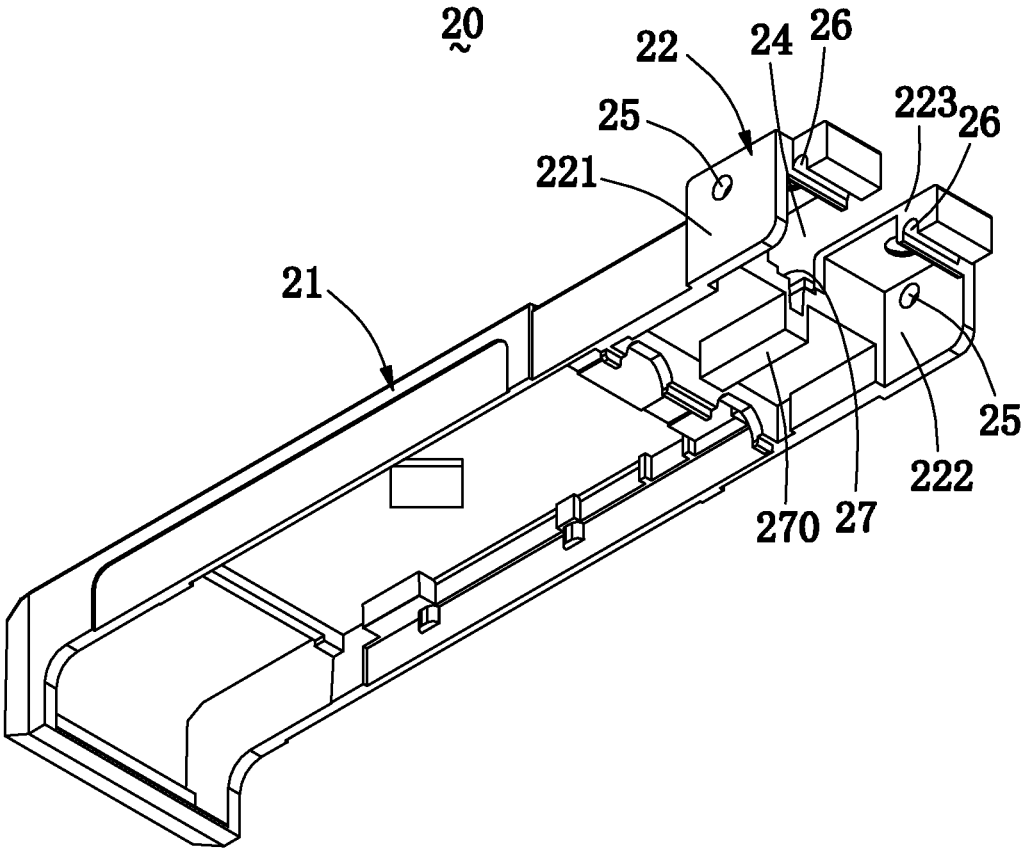
FIG. 4 is a perspective schematic view along another direction of a cover of FIG. 2.

Please refer to FIG. 4, the rear portion 22 of the cover 20 has a frame-shaped structure, which has a top wall 223, a left sidewall 221 and a right sidewall 222. Specifically, the rear portion 22 of the cover 20 includes an opening 24 being formed in the middle of the top wall 223 and cutting into two parts, a second shaft hole 25 passing through the left and right sidewalls 221, 223, and a bottom groove 26 formed on the bottom of the top wall 223 and located at rear of the second shaft hole 25. Please refer to FIGS. 2 and 4, the front portion 21 of the cover 20 includes a receiving chamber 27 located near the shoulder 23 and concaved downward from the top surface 210 of the front portion 22. The receiving chamber 27 is communicated with the opening along a length direction of the cover 20. In the embodiment, both the receiving chamber 27 and the opening 24 are located at a center line of the cover 20.

Figure 6:
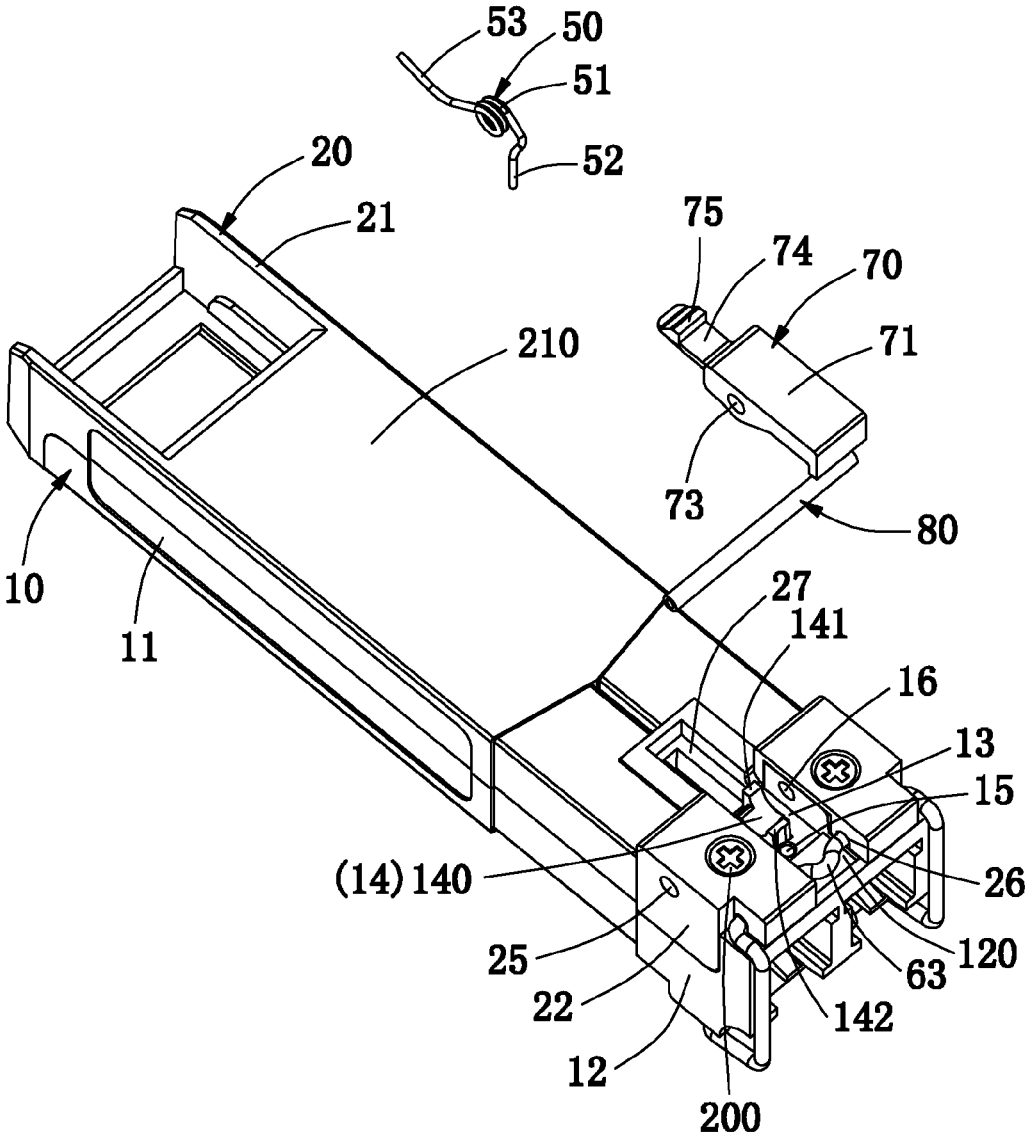
FIG. 6 is a schematic view obtained after the cover and the base of FIG. 2 are assemble together, wherein a shielding case is omitted here.

Please refer to FIG. 6, when the cover 20 is mounted on the base 10, the rear portion 22 of the cover 20 can partly cover the retaining portion 12 of the base 10. The opening 24 (the numeral 24 being shown in FIG. 2) of the cover 20 is corresponding to the retaining passage 13 of the base 10. The retaining passage 13, the spring seat 14 and the spring retaining hole 15 are exposed in the opening 24. The second shaft hole 25 of the cover 20 is aligned with the first shaft hole 16 of the base 10. The bottom groove 26 of the cover 20 is closed by the top surface 120 of the retaining portion 12. The receiving chamber 27 of the cover 20 is communicated with the retaining passage 13 of the base 10. Moreover, a bottom wall 270 (shown in FIG. 4) of the receiving chamber 27 is just located on the support beam 17 (shown in FIG. 3) of the base 10, and is supported by the support beam 17.

Please refer to FIG. 2, a locking and unlocking mechanism 40 comprises a torsion spring 50, an actuator 60, a rotating member 70 and a fastening shaft 80.

Please refer to FIG. 2, the torsion spring 50 can be mounted on the spring seat 14 of the base 10. The torsion spring 50 includes a cylindrical spring body 51, a vertical pin 52 extending from one end of the cylindrical spring body 51, and a horizontal pin 53 extending from the other end of the cylindrical spring body 51.

Please refer to FIG. 6, the cylindrical spring body 51 of the torsion spring 50 can be contained in the arc-shaped concave surface 140 of the spring seat 14. The vertical pin 52 is inserted into the spring retaining hole 15 of the base 10, and the horizontal pin 53 horizontally reaches into the receiving chamber 27 of the cover 20. Specifically, the vertical pin 52 is inserted into the spring retaining hole 15 along a rear surface of the rear block 142 of the spring seat 14, and the horizontal pin 53 extends from one side of the front block 141 into the receiving chamber 27. When the torsion spring 50 is mounted onto the base 10, the horizontal pin 53 is generally in an initial state.

Referring to FIG. 2, the actuator 60 can be rotatably mounted on the cover 20. The actuator 60 includes a horizontal rod 61, a handle 62 being connected with the horizontal rod 61, and an arc-shaped protrusion 63 protruding backward on the middle of the horizontal rod 61. In the embodiment, the handle 62 and the horizontal rod 61 are parallel to each other and are connected together by two U-shaped frames 64.

Please refer to FIGS. 2 and 6, the horizontal rod 61 of the actuator 60 can be rotatably held in the bottom groove 26 of the cover 20, the arc-shaped protrusion 63 is exposed to the opening of the cover 20, and the handle 62 is located outside the base 10 and the cover 20. In the embodiment, when the locking and unlocking mechanism 40 is in an initial state or a locking state, the handle 62 is hidden below the base 10. When the locking and unlocking mechanism 40 is in an unlocking state, the handle 62 can be lifted up and away from the base 10.

Figure 5:
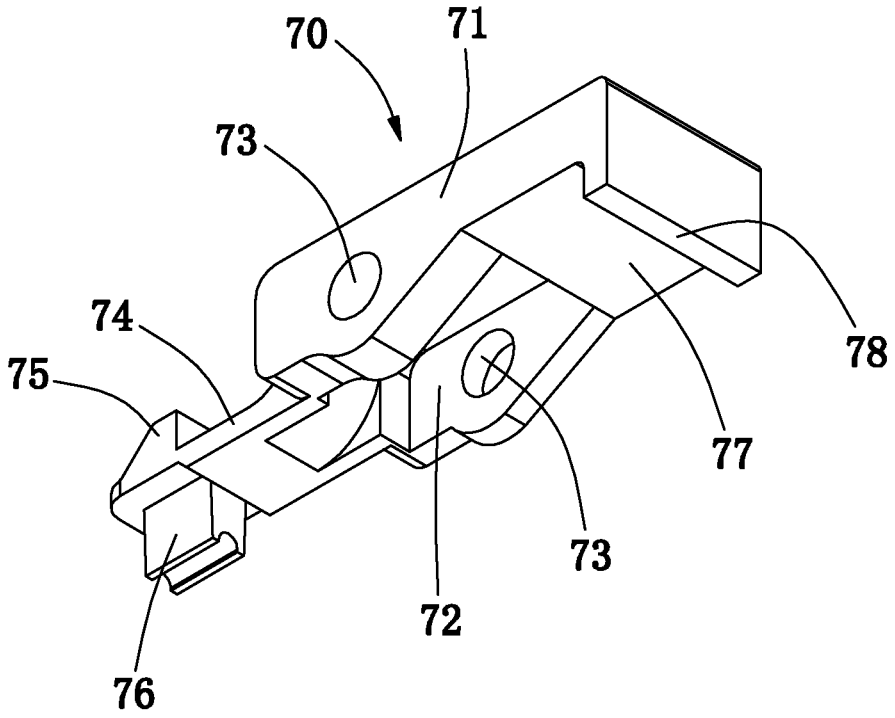
FIG. 5 is a perspective schematic view along another direction of a rotating member of FIG. 2.

Referring to FIG. 5, the rotating member 70 can be rotatably mounted on the cover 20 and the base 10 as shown in FIG. 2. The rotating member 70 has a main body 71, a receiving cavity 72 formed on the bottom of the main body 71, a third shaft hole 73 passing through two sides of the main body 71 and being divided into two sections by the receiving cavity 72, a latch arm 74 being located in front of the third shaft hole 73 and protruding forward from the front of the main body 71, a hook 75 located on the top of the latch arm 74, a spring-pressing portion 76 located on the bottom of the latch arm 74, a driving surface 77 located in rear of the third shaft hole 73, and a vertical wall 78 located in rear of the driving surface 77 and extending downward over the driving surface 77. In the embodiment, the driving surface 77 is a horizontal plane, and the spring-pressing portion 76 is a block extending downward.

Please refer to FIGS. 1, 5 and 6, when the rotating member 70 is mounted on the cover 20 and the base 10, the main body 71 can be just received in the retaining passage 13 of the base 10 and the opening 24 (shown in FIG. 2) of the cover 20, and the top of the main body 71 is horizontal to the top surface 220 of the rear portion 22. The receiving cavity 72 covers the cylindrical spring body 51 of the torsion spring 50. The third shaft hole 73 is aligned to the first shaft hole 16 and the second shaft hole 25. The latch arm 74 extends into the receiving chamber 27 of the cover 20. The hook 75 is located outside the receiving chamber 27 and protrudes out of the top surface 210 of the front portion 21 of the cover 20. The spring-pressing portion 76 is located in the receiving chamber 27 and can press the horizontal pin 53 of the torsion spring 50 to make the horizontal pin 53 move a certain distance downward. Now, the horizontal pin 53 can produce an upward thrust onto the latch arm 74, so that the hook 75 will possess a holding force. The driving surface 77 can be pressed unto the arc-shaped protrusion 63 of the actuator 60. The vertical wall 78 stands on the top surface 120 of the retaining portion 12 of the base 10 to prevent the hook 75 from being raised by the function of the horizontal pin 53 of the torsion spring 50, so that the hook 75 can maintain the initial state or the locking state.

Referring to FIG. 6, the fastening shaft 80 is inserted into the first shaft hole 16, the second shaft hole 25, the third shaft hole 73 and the cylindrical spring body 51 of the torsion spring 50, so that the rotating member 70 is pivoted on the base 10 and the cover 20.

Figure 7:
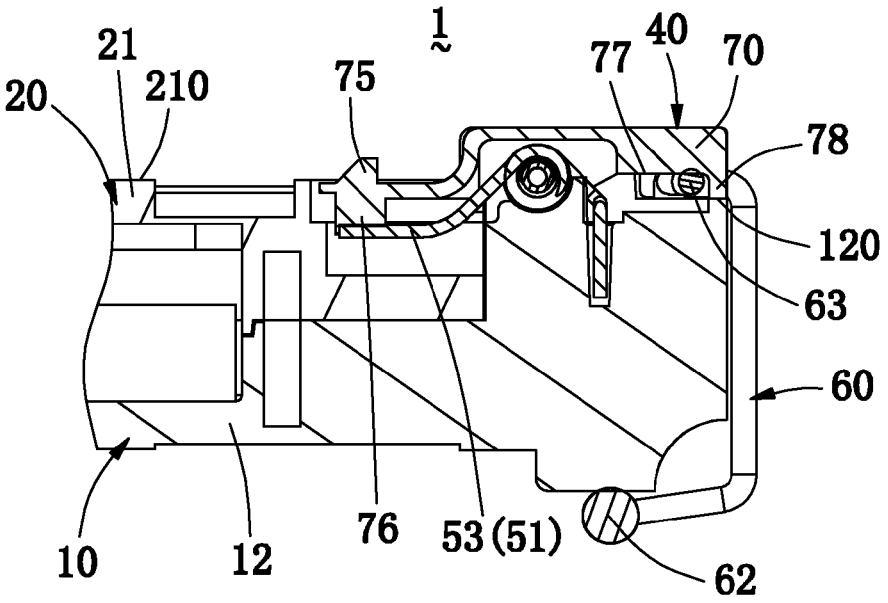
FIG. 7 is a partial section view showing that the locking and unlocking mechanism of the SFP connector of the present invention is in an initial state or a locking state.

Please refer to FIG. 7, the locking and unlocking mechanism 40 is in the initial state, the hook 75 of the rotating member 70 protrudes out of the top surface 210 of the front portion 21 of the cover 20, the spring-pressing portion 76 presses the horizontal pin 53 of the torsion spring 50, the horizontal pin 53 exerts the upward thrust onto the latch arm 74, so that the hook 75 possess the holding force. Now, because the vertical wall 78 of the rotating member 70 stands on the top surface 120 of the retaining portion 12 of the base 10, the rotating member 70 can not rotate clockwise. Moreover, the driving surface 77 of the rotating member 70 is pressed unto the arc-shaped protrusion 63, and the handle 62 of the actuator 60 is hidden below the base 10. When the SFP connector 1 is inserted into the shielding case 9 shown in FIG. 10, the hook 75 is pressed by an inner wall of the shielding case 9, then the hook 75 enters into a holding hole 90 of the shielding case 9 under the function of the torsion spring 50, so the SFP connector 1 can be fixed in the shielding case 9. Now, the locking and unlocking mechanism 40 of the SFP connector 1 is in the locking state.

Figure 8:
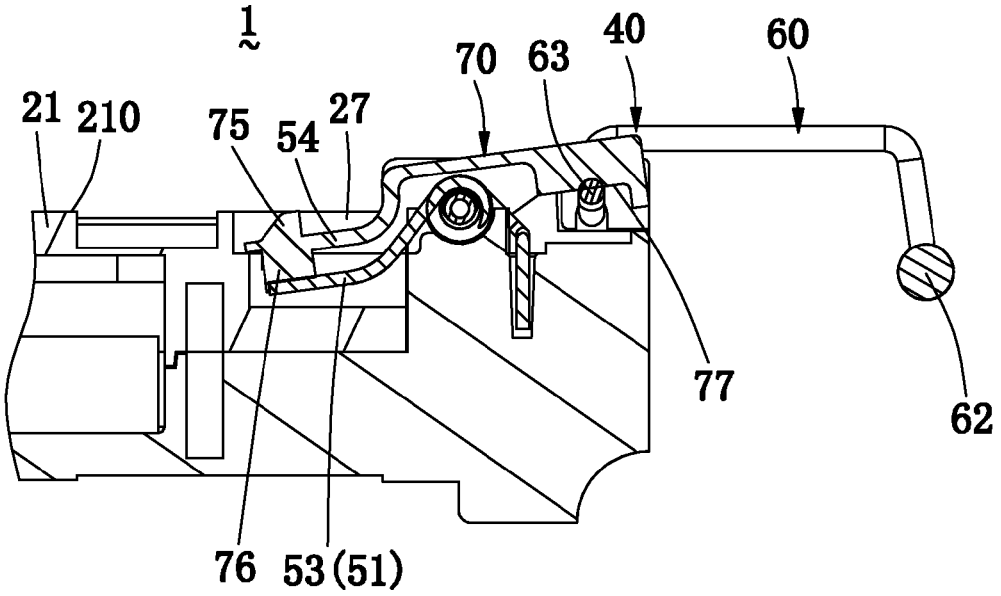
FIG. 8 is a partial section view showing that the locking and unlocking mechanism of the SFP connector of the present invention is in an unlocking state.
Figure 9:
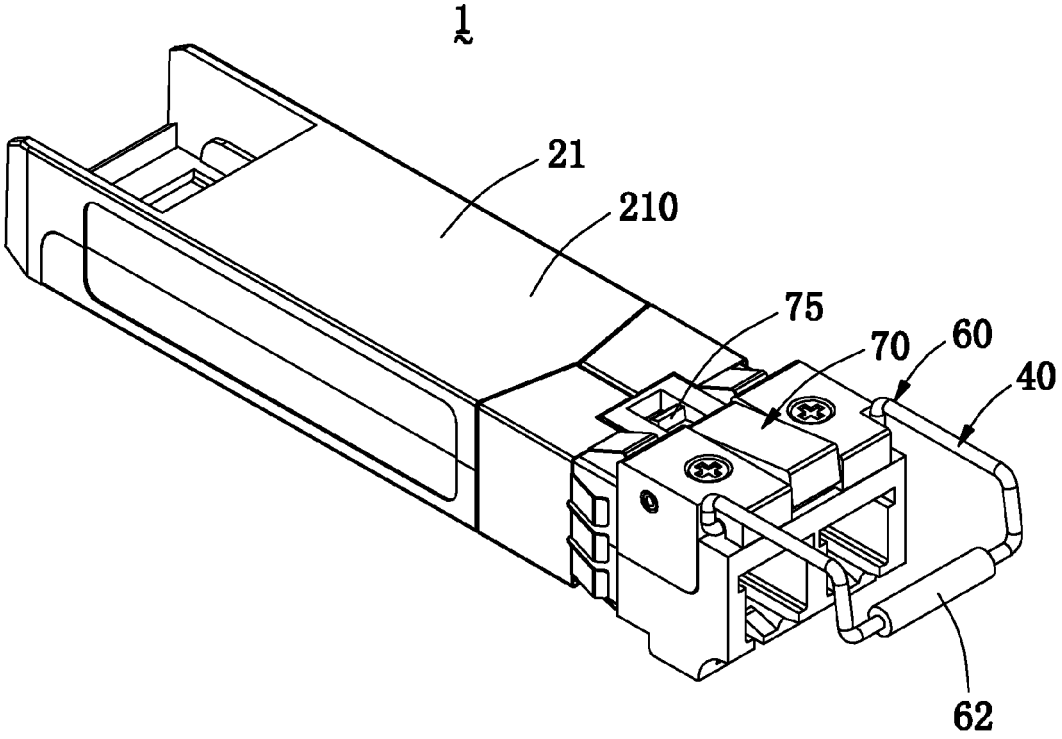
FIG. 9 is a perspective schematic view of the SFP connector of the present invention in the unlocking state.
Figure 10:
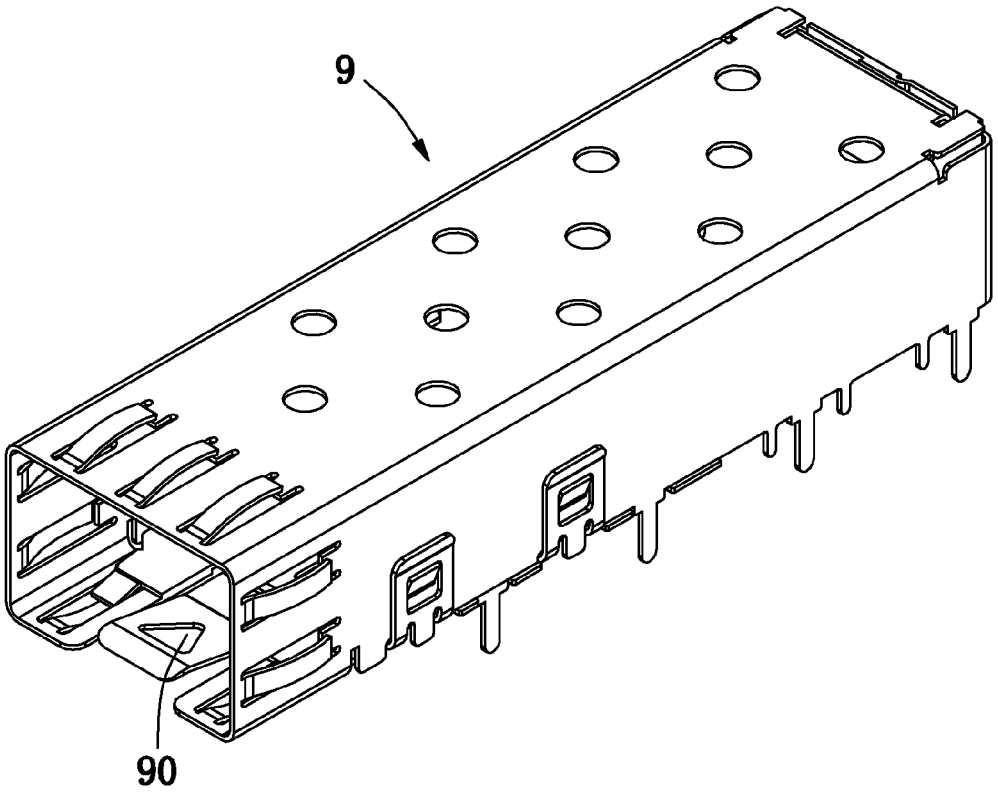
FIG. 10 is a perspective schematic view of a shielding case, which is used to receive the SFP connector of the present invention.

Please refer to FIGS. 8 and 9, when the SFP connector 1 needs to be pulled out of the shielding case 9 shown in FIG. 10, it is needed to raise the handle 62 of the actuator 60 and make the arc-shaped protrusion 63 rotate anticlockwise. The arc-shaped protrusion 63 will lift the driving surface 77 of the rotating member 70 upward and make the rotating member 70 rotate anticlockwise, so that the spring-pressing portion 76 of the latch arm 74 can press the horizontal pin 53 of the torsion spring 50 downward, and the hook 75 can go down into the receiving chamber 27 and is aligned with or lower than the top surface 210 of the front portion 21. Now, the locking and unlocking mechanism 40 of the SFP connector 1 is in the unlocking state. Therefore, the hook 75 may exit from the holding hole 90 of the shielding case 9, and the SFP connector 1 may be pulled out of the shielding case 9. After pulling out of the shielding case 9, the locking and unlocking mechanism 40 may return to the initial state under the function of the torsion spring 50.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A small form-factor pluggable connector with a locking and unlocking mechanism, comprising:

a base having an inserting portion located in the front thereof and a retaining portion located in the rear thereof; the retaining portion including a retaining passage located a top surface of the retaining portion, a spring seat disposed on the bottom of the retaining passage, a spring retaining hole formed on the bottom of the retaining passage and located at rear of the spring seat, and a first shaft hole passing through a left and right surfaces of the retaining portion and being cut into two sections by the retaining passage;

a cover having a front portion corresponding to the inserting portion and a rear portion corresponding to the retaining portion; the rear portion including an opening corresponding to the retaining passage of the base, a second shaft hole corresponding to the first shaft hole, and a bottom groove located at rear of the second shaft hole; the front portion including a receiving chamber concaved downward from a top surface of the front portion and communicated with the opening; when the cover being mounted on the base, the retaining passage, the spring seat and the spring retaining hole being exposed in the opening, the second shaft hole being aligned with the first shaft hole, the bottom groove being closed by the top surface of the retaining portion, and the receiving chamber being communicated with the retaining passage of the base; and a locking and unlocking mechanism including a torsion spring, an actuator, a rotating member and a fastening shaft;

the torsion spring being mounted on the spring seat of the base; the torsion spring having a cylindrical spring body, a vertical pin extending from one end of the cylindrical spring body and being inserted into the spring retaining hole, and a horizontal pin extending from the other end of the cylindrical spring body and entering into the receiving chamber;

the actuator being rotatably mounted on the cover; the actuator including a horizontal rod rotatably held in the bottom groove, a handle connected with the horizontal rod and located outside the base and the cover, and an arc-shaped protrusion protruding backward on the horizontal rod and being exposed in the opening;

the rotating member being rotatably mounted on the cover and the base; the rotating member having a main body received in the retaining passage and the opening, a receiving cavity formed on the bottom of the main body and used to cover the cylindrical spring body of the torsion spring, a third shaft hole that passes through two sides of the main body to be divided into two sections by the receiving cavity and is aligned with the first and second shaft holes, a latch arm located in front of the third shaft hole and protruding forward from the front of the main body to enter into the receiving chamber, a hook located on the top of the latch arm and protruding out of the top surface of the front portion, a spring-pressing portion located on the bottom of the latch arm and pressed unto the horizontal pin of the torsion spring, a driving surface located in rear of the third shaft hole and pressed unto the arc-shaped protrusion, and a vertical wall located in rear of the driving surface and extending downward over the driving surface to stand on the top surface of the retaining portion; and the fastening shaft being inserted into the first shaft hole, the second shaft hole, the third shaft hole and the cylindrical spring body of the torsion spring, and the rotating member being pivoted on the base and the cover.

2. The small form-factor pluggable connector with a locking and unlocking mechanism as claimed in claim 1, wherein the spring seat has an arc-shaped concave surface, a front block standing at front of the arc-shaped concave surface, and a rear block standing at rear of the arc-shaped concave surface; the cylindrical spring body of the torsion spring is contained in the arc-shaped concave surface, the vertical pin is inserted into the spring retaining hole along a rear surface of the rear block, and the horizontal pin extends from one side of the front block into the receiving chamber.

3. The small form-factor pluggable connector with a locking and unlocking mechanism as claimed in claim 1, wherein the actuator further includes two U-shaped frames to connect the handle and the horizontal rod, and the handle and the horizontal rod are parallel to each other.

4. The small form-factor pluggable connector with a locking and unlocking mechanism as claimed in claim 1, wherein the driving surface of the rotating member is a horizontal plane, and the spring-pressing portion is a block extending downward.

5. The small form-factor pluggable connector with a locking and unlocking mechanism as claimed in claim 1, wherein the rear portion of the cover is frame-shaped and has a top wall, a left sidewall and a right sidewall; the opening cuts the top wall into two parts, the second shaft hole passes through the left and right sidewalls, and the bottom groove is formed on the bottom of the top wall.

6. The small form-factor pluggable connector with a locking and unlocking mechanism as claimed in claim 5, wherein a top surface of the rear portion is higher than the top surface of the front portion to form a shoulder between the front portion and the rear portion, and the receiving chamber is located near the shoulder.

7. The small form-factor pluggable connector with a locking and unlocking mechanism as claimed in claim 6, wherein the small form-factor pluggable connector further comprises a grounding shell surrounding the cover and the base, being located near the shoulder, and forming a plurality of elastic pieces extending toward the shoulder.

8. The small form-factor pluggable connector with a locking and unlocking mechanism as claimed in claim 1, wherein the inserting portion of the base disposes a support beam for being used to support a bottom wall of the receiving chamber.

* * * * *